US009045873B1

(12) United States Patent
Moore, Jr.

(10) Patent No.: US 9,045,873 B1
(45) Date of Patent: Jun. 2, 2015

(54) LEACHING CHAMBER WITH WATER-PERMEABLE BARRIERS ON SIDEWALLS

(75) Inventor: Roy E Moore, Jr., Killingworth, CT (US)

(73) Assignee: INFILTRATOR SYSTEMS, INC., Old Saybrook, CT (US)

( * ) Notice: Subject to any disclaimer, the term of this patent is extended or adjusted under 35 U.S.C. 154(b) by 0 days.

(21) Appl. No.: 13/092,926

(22) Filed: Apr. 23, 2011

Related U.S. Application Data

(60) Provisional application No. 61/343,361, filed on Apr. 27, 2010.

(51) Int. Cl.
*E02B 11/00* (2006.01)

(52) U.S. Cl.
CPC ..... *E02B 11/00* (2013.01)

(58) Field of Classification Search
USPC ..... 405/36, 43, 45, 49, 44, 46; 210/170.08
See application file for complete search history.

(56) References Cited

U.S. PATENT DOCUMENTS

| | | | | |
|---|---|---|---|---|
| 3,830,373 | A | 8/1974 | Sixt et al. | |
| 3,946,762 | A | 3/1976 | Green | |
| 4,904,113 | A | 2/1990 | Goddard et al. | |
| 4,909,665 | A * | 3/1990 | Caouette | 405/45 |
| 5,419,838 | A | 5/1995 | DiTuillo | |
| 5,441,363 | A * | 8/1995 | Gray | 405/49 |
| 5,516,229 | A | 5/1996 | Atchley et al. | |
| 6,461,078 | B1 | 10/2002 | Presby | |
| 6,702,517 | B2 | 3/2004 | Goddard | |
| 7,207,747 | B1 | 4/2007 | England | |
| 7,451,784 | B2 | 11/2008 | Goddard | |
| 7,611,306 | B1 * | 11/2009 | Hallahan et al. | 405/46 |
| 2010/0329789 | A1 * | 12/2010 | Coppes et al. | 405/49 |

FOREIGN PATENT DOCUMENTS

DE 3802723 * 8/1989

OTHER PUBLICATIONS http://dictionary.reference.com/browse/fit.*
http://dictionary.reference.com/browse/frame.*

* cited by examiner

*Primary Examiner* — Sean Andrish
(74) *Attorney, Agent, or Firm* — C. Nessler

(57) ABSTRACT

Barriers are placed over openings in the opposing sidewalls of leaching chambers used for receiving and dispersing water within soils. The barriers enable outward flow of water and hinder inward movement of soil. Exemplary barriers such as geotextile may be attached directly to the sidewall of the chamber. In another approach, panels comprised of barrier material contained with a frame, and the panels are placed on the chamber sidewall at the location of the openings.

11 Claims, 4 Drawing Sheets

LEACHING CHAMBER WITH WATER-PERMEABLE BARRIERS ON SIDEWALLS

This application claims benefit of provisional patent application No. 61/343,361 filed Apr. 27, 2010.

TECHNICAL FIELD

The present invention relates to plastic chambers for burial in soil, to receive and disperse wastewater.

BACKGROUND

Familiar arch shape cross section molded plastic corrugated leaching chambers are buried in soil for use. They have opposing sidewalls which run upwardly and inwardly from opposing side base flanges to a solid top. Chambers must be strong enough to resist the overlying load of soil and any objects such as vehicles which move across the soil surface. The chamber sidewalls have commonly been perforated for flow of water laterally into the surrounding soil. The chamber construction or installation should hinder soil particulates from moving into the chamber interior and allow good outward flow of wastewater. In some situations that aim is achieved by the configuration of the chamber itself. For example, the chamber has downward sloping slots. In other situations, the chamber has holes which are not suited to inhibiting soil movement, and a barrier sheet such as geotextile filter fabric is interposed between the soil and chamber, as discussed further below. Generally, it is desirable to maximize sidewall leaching area per unit length of chamber. The leaching area of a chamber comprises both the exposed soil area at the base of the chamber and the water-exposed soil area adjacent the sidewalls of the chamber.

In one typical type of injection molded chamber, the peak and valley corrugations have downward sloping slots which are defined by louvers. See U.S. Pat. No. 7,189,027 of Brochu et al., where the chamber has a continuous curve arch. See U.S. Pat. No. 4,759,661 of Nichols et al. where the chamber has planar sidewalls and a generally trapezoid shape cross section. Louvers which define slots have often been structural parts of the sidewalls; first, in being a part of the sidewall structure which transfers the down-load of overlying soil to the base flanges; and, second, in resisting the lateral or inward-force of soil. There are countervailing aims when there are slotted sidewalls. The essential aim is to maximize the exposed soil area into which wastewater may flow. On the one hand, the openings should be large, and the down-slope small, so there is a resultant large open area, to maximize the outflow of water. On the other hand, the openings should be small and the down-slope steep, to minimize inflow of particles, and maximize the structural plastic per unit area in the sidewall. A practical design compromise is typically reached. See U.S. Pat. Nos. 5,511,903, 7,189,027 and other patents referenced herein for examples.

Other kinds of molded plastic leaching chambers have spaced apart round or of other shape openings. For example, chambers made by thermoforming plastic sheet have such kind of sidewall perforations, which typically might be made in a secondary operation. See U.S. Pat. No. 5,087,151 of Ditullio for a thermoformed chamber with round sidewall holes. Round holes of substantial size generally necessitate the use of geotextile draped over the chamber, before a leaching trench is backfilled with common soil. Holes must not be so large that that the force of soil can push geotextile through the opening. Typically, non-slotted holes are of the order of 0.5-1 inch diameter. In some installations, a geotextile filter fabric is laid over a slotted sidewall chamber, to inhibit inflow of fine sand particles. For example, see U.S. Pat. No. 7,207,747 of England, which describes how geotextile is either wrapped around a chamber or run lengthwise along the chamber sidewalls.

There is a continuing aim to lower the cost of leaching chambers, such as by decreasing the weight of plastic, thus reducing manufacture cost, while maintaining strength and adequate sidewall leaching area; or by decreasing the cost of molds and molding. Different soils may indicate different sidewall opening configurations. If openings in a chamber sidewall are made small to resist fine particulates, leaching area per unit length is reduced and such chamber will be inefficient in coarse soils, e.g., more small-opening chambers are needed to meet a particular total leaching area than would be the case if the sidewall was tailored to a coarse material.

While different chamber models might be molded, each having a particular sidewall configuration, that would mean not only increased mold costs and inventory costs, but this approach is impractical in the market place. When, as described above, geotextile is placed over the whole of a leaching chamber, labor and material costs are increased. Thus, there is a need to address these issues in an economic way.

SUMMARY

An object of the invention is to provide a plastic leaching chamber which has improved means for sidewall leaching area. Another object is to reduce the amount of plastic which is needed to make the chamber have good sidewall leaching area. Another object is to provide a means for manufacturing chambers which are adaptable to having different sidewall characteristics, with respect to inhibiting inflow of soils of different character. A further object is to provide such a chamber which has low cost of manufacture and which is easy to install.

In accord with the invention an arch shape cross section chamber has a plurality of openings in opposing sidewalls, each opening having an associated water permeable barrier attached directly or indirectly to the sidewall in proximity to the periphery of the opening. The barrier enables outflow of water from the interior of the chamber to the exterior of the chamber while hindering inflow of solids, when the chamber is buried in soil during use.

Also in accord with the invention a corrugated arch shape cross section chamber has a water permeable barrier directly or indirectly fastened to the chamber so it covers a plurality of relatively large openings in the opposing sidewalls of the chamber. The barrier may be comprised of one or more materials suitable for preventing the entry of unwanted solids which are outside the chamber, while allowing outward flow of water. For example, the barrier may be a geotextile or a finely perforated sheet. Preferably the openings having barriers are in peak corrugations which are much wider than the valley corrugations which separate adjacent peak corrugations. In embodiments of the invention, barriers are applied to openings in either or both peak corrugation portions and valley corrugation portions of the chamber sidewall.

In an embodiment of the invention, a barrier is attached directly to chamber sidewall at the periphery of the opening in the sidewall of the chamber. Optionally there is a land or rib which runs around the periphery of the opening, and the barrier is attached to that. There may be struts or the like running across the opening, to support the barrier against the inward thrust of soil.

In another embodiment, the barrier is part of a subassembly which is attached to or sets within the opening in the sidewall of the chamber. For example, a panel comprised of the barrier and a frame fits within, or over, an opening in the chamber sidewall.

The openings which are covered by barrier are large compared to chamber sidewall openings of the prior art. In embodiments of the invention, the opening having a barrier is at least 60%, preferably 70% or more of the area of the local portion of sidewall having the barrier.

In an improved method of making chambers, the need for inventorying and making chambers having different sidewall character is reduced. In the method, different sets of barriers (with or without frames) are formed, where each set provides a desired different sidewall leaching characteristic. A multiplicity of chambers are made with the kind of openings of approximately the same size as the barriers. A chosen first set of barriers is selected and attached to a first portion of the chambers, and a chosen second set of barriers is selected and attached to a second portion of the chambers.

The foregoing and other objects, features and advantages of the present invention will become more apparent from the following description of preferred embodiments and accompanying drawings.

DESCRIPTION

The present invention may be used in combination with the invention described in U.S. Pat. No. 7,914,230, entitled "Corrugated leaching chamber with hollow pillar supports," which has ownership in common herewith and is hereby incorporated by reference. In embodiments of chambers which are described in the foregoing patent there is a unique relationship between the widths of the peak corrugations and valley corrugations at the sidewalls. For example, each peak corrugation is substantially larger in width than the width of each valley corrugation, as width measured in the lengthwise direction of the chamber just above the base flange elevation; and slot perforations are preferably present in the peaks but not in the valleys. (For brevity, the term peaks is often used here to describe a peak corrugation and the term valley is used to describe a valley corrugation.) The present invention is particularly useful with such type of sidewall corrugations which are exemplified here by FIG. 10, but will be useful for chambers having other peak and valley relationships.

Figure 1:
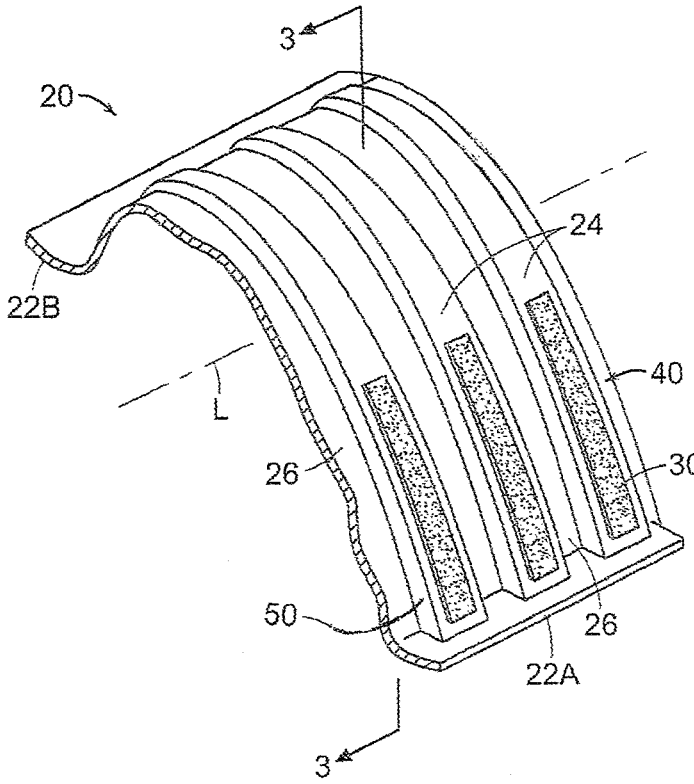
FIG. 1 is a quasi-isometric view of an end portion of a corrugated leaching chamber having fabric panel sidewalls.
Figure 2:
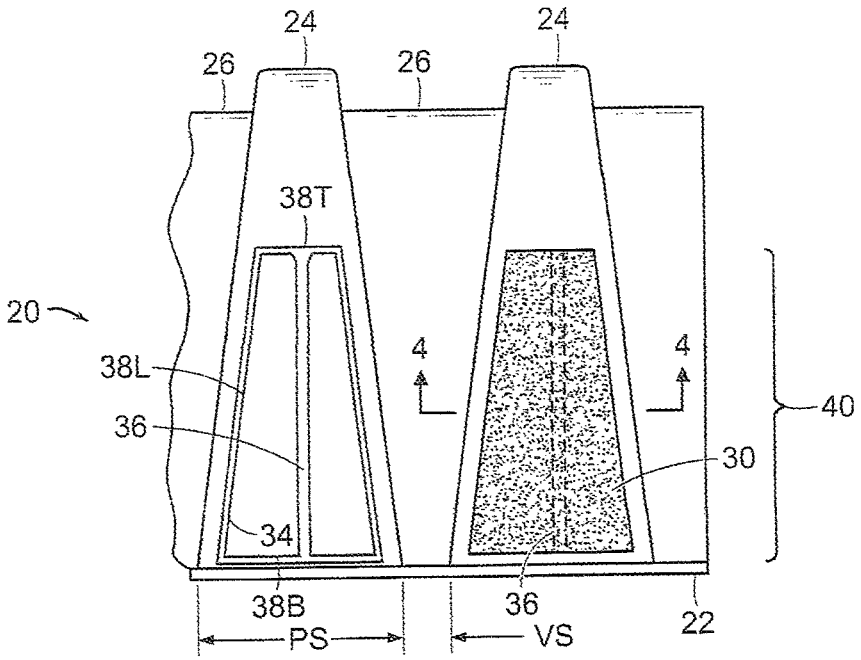
FIG. 2 is a side elevation view of the chamber of FIG. 1.
Figure 3:
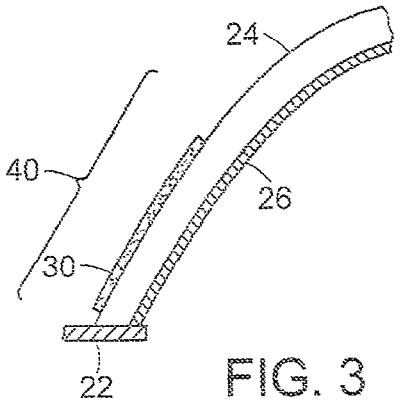
FIG. 3 is a partial vertical cross section view of the chamber of FIG. 1.

FIG. 1 shows a portion of an arch shape cross section corrugated plastic leaching chamber 20, having a length axis L. FIG. 2 is a side view and FIG. 3 is a vertical transverse plane cross section. The chamber has alternating peak corrugations 24 and valley corrugations 26 which run transverse to the length axis. The corrugations run upwardly from one base flange 22A, along the sidewall and top which comprise curved arch of the chamber cross section, and down to the opposing base flange 22B. Sidewall 40 of the chamber is that portion of chamber which rises from a base flange toward the top. See FIG. 1 and FIG. 2. The sidewall has peak corrugations and valley corrugations. The top is a typically solid portion which connects the upper ends of the sidewalls. The sidewalls of prior art chambers typically have horizontal slot perforations. In the chamber of FIG. 1 the sidewalls have openings which are covered with barriers 30, one species of which is water permeable geotextile sheets 32. In the chamber of FIG. 1-3, the sidewalls 40 of chamber 20 comprise peak corrugations 24 which having openings 34, each of which is covered with a barrier 30 having a construction which allows the passage of wastewater out of the chamber while inhibiting inflow of soil. (In FIG. 2, the opening on the left awaits the barrier.) The barrier hinders the entry of particles of sand and other substances which comprise the soil or other substitutional medium that is adjacent to the chamber sidewall. In this sense, the barrier can be considered to function as a filter. As more particularly described below, the barrier may be a polymer geotextile or other material which allows water to contact the soil; or the barrier may be a molded or machined plastic structure, such as a spaced apart louvers defining slots.

In embodiments of the invention, a barrier 30 is secured directly or indirectly to part or all of the chamber structure which circumscribes an opening in the sidewall. In one embodiment, described first and shown in FIG. 1 to FIG. 4, the barrier 30 is directly affixed to the chamber sidewall in proximity to the edge of an opening 34. In a second embodiment, exemplified in FIG. 13 and FIG. 14, the barrier is affixed indirectly to the chamber sidewall by being attached to a separately formed frame which fits onto the sidewall or within the opening of the sidewall. The combination of frame and barrier is called here a panel. A panel 102 is received within an opening in the sidewall of the chamber. This embodiment is described further below.

A barrier has a multiplicity of small openings for passage of water. A preferred barrier is comprised of commercial geotextile, e.g., a woven or non-woven perforated sheet of polyolefin, preferably polypropylene, like the geotextile used for draping over leaching chambers in the past. See for example, U.S. Pat. No. 7,207,747 of England, the disclosure of which is hereby incorporated by reference. An exemplary barrier is Mirafi No. 160N geotextile (TenCate Geosynthetics, Pendergrass, Ga.). Selection of a particular geotextile, or other barrier material, and its attendant average pore opening size property, may be a function of the character of the soil which is anticipated to contact the sidewall during use. Barriers other than geotextile may be used, as described below.

Referring again to FIG. 1-4, each peak corrugation 24 has an opening 34 and an associated water permeable barrier 30. The size of the opening is large compared to the openings in prior art leaching chambers and as compared to the openings which the barrier material provides. Without a barrier the opening sizes on typical chambers of the present invention would allow excess amounts of soil to enter the chamber, e.g., where soil comprises natural or artificial medium which has a particle size smaller than common pea stone. In the chamber 20 embodiment, opening 34 is bisected by an optional vertical strut 36 to lessen the deflection of the barrier under inward force for soil within which the chamber is buried.

In embodiments of the invention, a preferred geotextile barrier is attached to the chamber proximate the edges of the opening 34 and optionally to the center strut 36 or such other struts as may be present. The attachment may be made by one or a combination of means including such as adhesive bonding, taping, welding, hot melt fusion, and mechanical fastening (such as with staples or pins, with or without an associated rail or cleat). The barrier may be attached at the exterior of the chamber; or it may be attached to the interior. The attachment of the barrier to the structure of the chamber may be continuous of non-continuous. Preferably, the barrier will be attached along at least 50 percent, more preferably 90 percent or more, of the length of the periphery of an opening. In another way of attaching the barrier, which will be well understood from the discussion below about FIG. 13 and FIG. 14, a geotextile barrier may be laid on the sidewall and a frame may be pressed into the opening, thereby clamping the geotextile between the frame and the periphery of the opening. When a barrier is suitably attached to the chamber, it will resist the forces due to the inward-pushing soil, i.e., those which result in tensile forces in the barrier.

Figure 4:
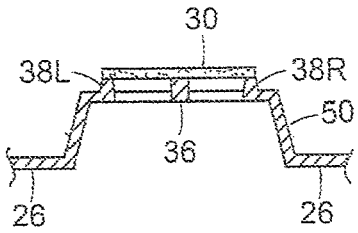
FIG. 4 is a horizontal plane cross section of the sidewall of the chamber of FIG. 1.

To facilitate attachment of the barrier, and to strengthen the chamber sidewall in vicinity of the opening, small ribs—alternately called lands, 38L, 38R, 38T and 38B are adjacent the edges of the opening as shown in FIG. 2 and the horizontal plane cross section of FIG. 4. Lands 38, which may be conceived as being small ribs, are raised or thickened portions of the chamber sidewall at or proximate to the edges of an opening 34. In the generality of the invention there need be no strut, nor any lands 38, where the barrier is attached.

The side elevation view of a portion of chamber in FIG. 2 shows exemplary chamber 20 has peaks of widths PS, which widths are much wider than the widths VS of the valleys. In an exemplary chamber, the width PS may be about 2 to 4 inch and the width VS may be about 0.5 to 1 inch. The basic thickness of an exemplary chamber (i.e., the typical thickness of the chamber wall at locations away from openings 34) may be 0.050 to 0.250 inch. Other useful peak and valley relationships are described in aforementioned U.S. Pat. No. 7,914,230.

Corrugation widths are measured in the lengthwise direction of the chamber, just above the elevation of the base flange 22 and associated base flange fillets. Measuring technique is discussed further below. Having such a desirable large peak and small valley relationship enables a reduction in the number of openings at which barriers are attached and thus simplifies manufacturing; it also may provide other advantages such as increased number of peak corrugations per chamber length compared to equal peak and valley widths, and thus increased strength.

An exemplary arch shape cross section chamber of the kind shown in FIG. 1-4 is about 34 inches wide at the base, and the height at the center may be in the range 8 to 16 inches. A chamber of the present invention may have no interior pillar, or it may have pillars in the center of the chamber as described in U.S. Pat. No. 7,914,230 which is incorporated by reference.

Figure 8:
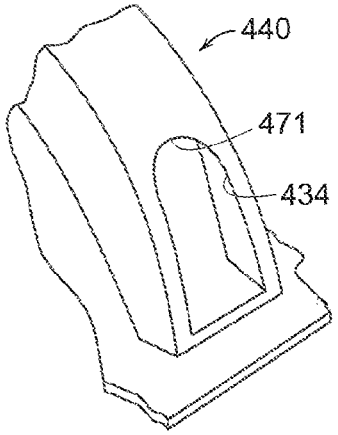
FIG. 8 shows in quasi-isometric view a sidewall portion having an opening with an arch shape top.
Figure 9:
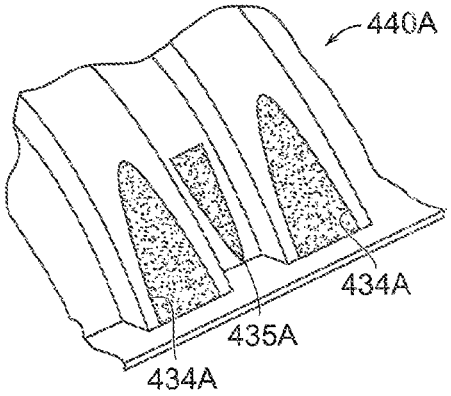
FIG. 9 shows in quasi-isometric view a sidewall portion having a triangular shaped openings.

The peak corrugation openings described thus far, for receiving panels, are generally trapezoidal in shape. Other shape openings are within contemplation. For example: FIG. 8 shows a sidewall portion 440 having an opening 434 with a curved arch shape top 471. And FIG. 9 shows generally triangular apex-up openings 434A in the peaks of chamber sidewall 440A and a typical apex-down triangular opening 435A in a valley.

Figure 6:
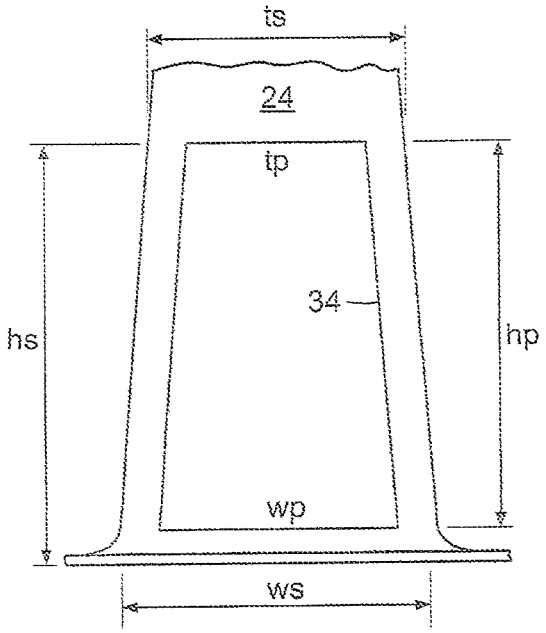
FIG. 6 is a side elevation view of a portion of sidewall showing how barrier associated areas are dimensioned.

The area of an opening in the chamber sidewall is the area which is defined by the periphery of the opening (adjusted for the space occupied by any struts). As an example, with reference to semi-schematic representation of a sidewall portion in FIG. 6 (where the opening is ready to receive a barrier), the area of the sidewall for a peak corrugation 24 is the area defined by the trapezoid having a base ws, a top ts, and a height hs. The area of the opening 34 in the sidewall is the area of the trapezoid having a base wp, a top tp, and a height hp.

Figure 7:
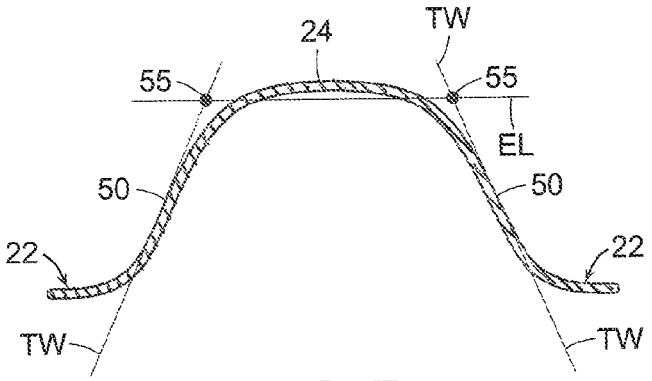
FIG. 7 is a horizontal plane cross section of a peak corrugation portion of a sidewall showing how barrier associated areas are dimensioned.
Figure 10:
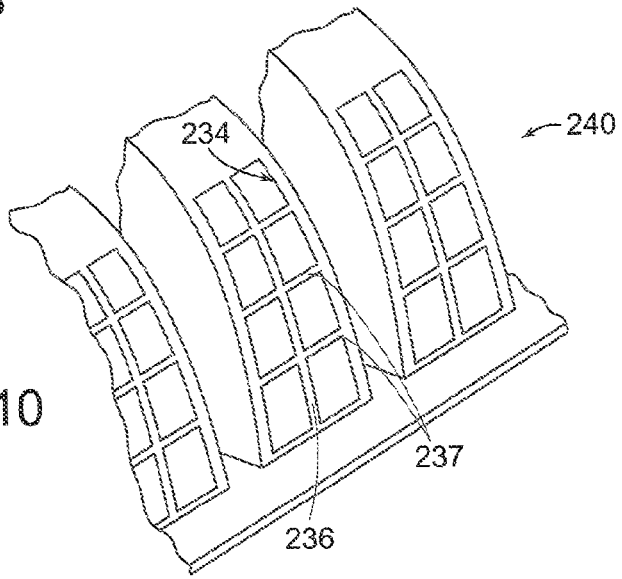
FIG. 10 shows in quasi-isometric view a portion of chamber sidewall, showing cross shape struts which strengthen an opening in the sidewall.

Adjacent peaks 24 and valleys 22 share webs 50. See FIG. 7. As shown in FIGS. 1, 9 and 10, certain chamber embodiments have valleys and webs which are free of openings. With reference to FIG. 7 which shows in horizontal plane cross section a portion of chamber sidewall, the sidewall corrugations often may comprise curves, and when they are relatively shallow, the area of opening and associated sidewall may be determined in simplified fashion, as follows: In FIG. 7 peak corrugation 24 and associated webs 50 (which connect the peaks 24 with the valleys 22) are curved. With reference also to FIG. 7, the dimensions ws and is are the lengths of straight EL lines which best fit the curve of the exterior surface and run between points 55. Points 55 are points where the straight lines EL intersect the best fit tangents TW to the mean curve of the webs 50. If the opening for a panel is in a valley, the areas of sidewall and opening are determined in analogous fashion. If the sidewall corrugations are severely curved, then the calculation of the areas of the barrier-covered opening and the sidewall portion would take into account the curvature, and be determined using applicable conventional engineering principles. In embodiments of the invention, the opening having a barrier is at least 60%, preferably 70% or more, of the area of the local portion of sidewall having the barrier.

Figure 5:
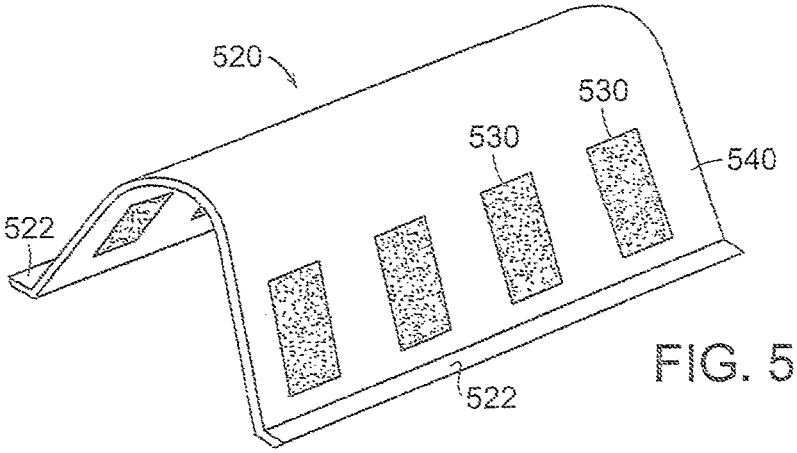
FIG. 5 shows a un-corrugated chamber having barrier covered sidewall openings.

Thus far, the invention has been described in connection with chambers having corrugations because such chambers have desirable strength to weight ratios. In the generality of the invention, a chamber may have no corrugations. For example, in FIG. 5 chamber embodiment 520 comprises a substantially smooth formed arch shape cross section sheet having base flanges 522. A plurality of barrier covered openings 530 are spaced apart along the length of the chamber sidewall 540.

The invention will be applicable to chambers which have sidewalls which curve upwardly and inwardly as pictured in the Figures here, as well as to chambers having planar sidewalls, such as chambers shown and described in U.S. Pat. Nos. 4,756,661 and 5,511,903, the disclosures of which are hereby incorporated by reference.

In embodiments of the invention, a panel may comprise a material other than a sheet of geotextile. For example, the barrier may comprise molded plastic material such as a plurality of louvers which define slots, or a thin perforated plastic sheet, or woven mesh screen comprised of fine filaments of corrosion resisting metal or other like strong and corrosion resistant material. Preferably, a barrier will have a relatively high percent of opening area for flow of water, such as an opening area of about 40-50 percent or more. A barrier may comprise more than one layer of the same or differing materials. In a preferred embodiment of the invention, the chamber potentially has equal or greater leaching area than the same configuration chamber would have if the barrier area was comprised of prior art louvers and slots; and it will provide adequate resistance to the inward force of soil.

FIG. 10 shows a portion of a sidewall 240 of another chamber embodiment in which a typical opening 234 has horizontal struts 237 in addition to a vertical strut 236 (of which there may be more than one). Barrier material (not shown) may be attached to some or all of the multiplicity of struts and the periphery of the opening.

Figure 11:
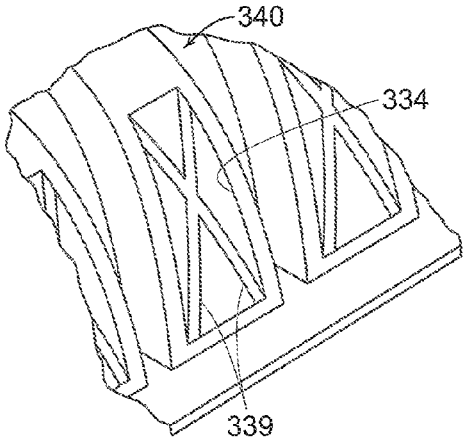
FIG. 11 shows in quasi-isometric view a sidewall portion having an opening with an X shape strut system.

FIG. 11 shows a portion of a sidewall 340 of another chamber embodiment in which there are diagonal struts 339 forming an X-shape within the opening 334.

Figure 12:
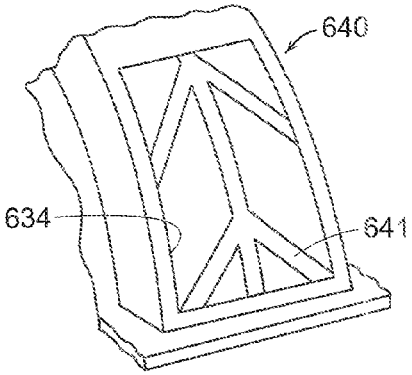
FIG. 12 shows in quasi-isometric view a sidewall portion having an opening with a double chevron strut system.

FIG. 12 shows a portion of sidewall 640 of another chamber embodiment having an opening 634 with strut structure 641 comprised of two pairs of chevron pattern struts and a vertical strut.

Struts (and previously mentioned lands 38) may also serve as a plastic flow channel during injection molding. Other combinations of struts may be used within the opening. Instead of struts, the opening may be filled with a perforated plate or geogrid, to provide structural support for a geotextile barrier, as well as strength to the sidewall.

Figure 13:
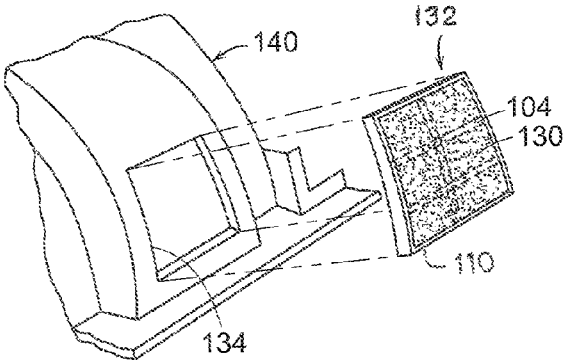
FIG. 13 in quasi-isometric exploded view how a framed barrier panel insets into a peak corrugation portion of the sidewall of a chamber.

FIG. 13 shows another embodiment of the invention in exploded view, wherein barriers are affixed indirectly to the sidewall 140 of chamber 120. In an exemplary embodiment, panel 132 is fabricated independently of a chamber. It is then set within opening 134 in a peak corrugation (or in the opening of a valley corrugation when the design of the chamber is such as to accommodate a valley with an opening). Panel 132 may be an assembly comprised of semi-rigid frame 110 to which is attached barrier 130. The frame 110 is preferably made of plastic like that of the chamber. The frame 110 may comprise struts 104 and other support structures within the frame, in accord with the teachings above about struts. The barrier 130, preferably a polymer geotextile or other material as described above, is attached to the frame by one of the various means described above in connection with attaching barriers directly to chamber sidewalls.

Typical frame 110, and thus panel 132, is received in an opening 134 of the sidewall 140 of chamber 120, as shown in FIG. 13. In one embodiment, the frame is mechanically snapped into place by virtue of the interlocking design of the edges of the opening and the periphery of the frame. In another embodiment, the frame may be bonded, welded, screwed, or otherwise fastened to the chamber wall surface adjacent the opening, or within the periphery of the opening. In another embodiment, the frame shape approximates the opening shape and the frame is attached to the exterior or interior surface of the chamber sidewall adjacent the opening. In still another embodiment, the frame 110 is captured in the sidewall by positioning it within an injection molding mold during the step of injection molding the chamber. When separately-fabricated panels are used, the barrier is characterized as being indirectly attached to the sidewall of the chamber.

Figure 14:
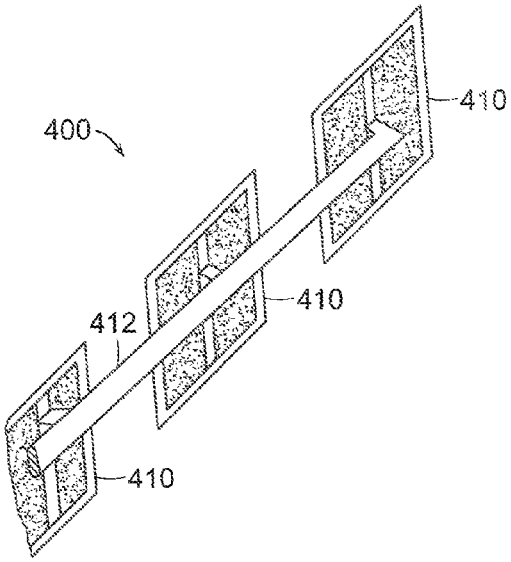
FIG. 14 is a view showing an assembly of panels with support bar.

FIG. 14 shows a further embodiment of the invention. An assembly such as assembly 400 comprises a set of two or more panels 410 (three are shown in FIG. 14), spaced apart along support bar 412. The spacing corresponds with the spacing of openings in the chamber sidewall. Thus, many panels can be set in place simultaneously in openings in the sidewalls. Bar 412 can be left in place after the panels are placed onto the sidewall, or it may be cut away. In other embodiments, bar 412 may be attached to the chamber by means not shown, to secure the panels in place; or each panel may be secured in place as previously described.

As mentioned above with respect to the plain barrier, the panels may be affixed to the interior of the chamber instead of the exterior of the chamber.

Using barriers, with or without panels, avoids limitations imposed by molding practice on what may be in the sidewall, to inhibit inflow of soil. Using barriers facilitates having alternative and specialized sidewall construction. The composition, thickness, or porosity of barriers may be varied amongst chambers much more conveniently than when the sidewall is wholly molded. When a panel is used, with or without an associated support bar, it can simplify the installation of the barrier. Panels may be made separately in a mass production operation, and the secondary operation of putting barriers across sidewall openings may be simpler individually fastening a barrier directly to the chamber at each opening. Another advantage may be realized when panels are inserted in the chambers near to the point of installation, thus avoiding the possibility of damage during transport and handling.

In the generality of the present invention: A chamber may have barriers, attached directly or indirectly to openings in both peaks and valleys, or to openings in only one of the peaks or valleys. And a chamber may have peaks and valleys where the peaks are wider than the valleys, where the valleys are wider than the peaks, or where the peak and valley widths are equal. A chamber may have other perforations in the sidewalls which are not covered with barriers. For instance, one or more peaks and/or valleys may have slots or small holes for leaching or other purposes.

Chambers may have more than one opening in the sidewall at each of one or more peak or valley corrugations and an associated barrier. For example, there may be two vertically extending openings next to each other on each corrugation. For example, there may be a lower opening and an upper opening on each corrugation.

A chamber of the present invention is preferably made of an olefin thermoplastic, such as polypropylene or polyethylene, by means of injection molding. Other plastics and other means of forming, such as thermoforming, may be used in embodiments of the invention.

The present invention enables improvement in the manufacture of chambers, including chambers which have different sidewall leaching character; in particular, sidewalls tailored to soil or regulatory characteristics. In a method of the present invention, chambers of the types described above are molded, such as by injection molding or other means, such as thermoforming. For a way of injection molding, see U.S. Pat. No. 5,401,459, the disclosure of which is hereby incorporated by reference. Each chamber has a multiplicity of the large like-sized sidewall openings, such as openings 34, 134, 234, 334, 434 described above. There may be more than one group of like-sized openings. For example, there may be smaller openings in the valleys and larger openings in the peaks of a corrugated chamber. Different sets of barriers, each comprising a multiplicity of barriers having sizes approximating the size of the openings of one of opening groups, may be formed separately from the chamber. The barriers of a set may or may not have associated frames, i.e., they may or not be in the form of panels. Each set has barriers of a desired character. For instance, a first set of barriers may be made from a perforated non-woven geotextile, like the above mentioned Mirafi N160 material; a second set of barriers may be made from the different Mirafi material; and a third set of barriers may be comprised of louvers approximating a prior art sidewall. To make a particular type of chamber, barriers from one of the sets are selected and attached directly or indirectly to the sidewall at the openings as shown in the Figures by one of the means described above. In one mode, the barriers are mated with the chamber at the factory; in another mode, the mating is done at a site remote from the factory. Thus the method simplifies the manufacture and stocking of chambers having differing sidewall characteristics.

The invention, with explicit and implicit variations and advantages, has been described and illustrated with respect to one or more embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail without departing from the spirit and scope of the claimed invention.

What is claimed is:

1. In the method of fabricating a leaching chamber for receiving and dispersing water when buried in soil, wherein the chamber is made of injection molded plastic, has a top, a length, an arch shape cross section, an interior for receiving water, an exterior, opposing side base flanges, and two opposing corrugated sidewalls, each sidewall running upwardly and inwardly toward the top of the chamber from one of said opposing side base flanges, wherein each opposing sidewall has a plurality of openings spaced apart along said chamber length, for the passage of water from the interior of the chamber to the exterior of the chamber, the improvement which comprises:

(a) molding a chamber with a multiplicity of like-sized openings with like-size peripheries in each opposing sidewall;

(b) separately forming from plastic at least two sets of panels each panel comprising a frame and attached barrier, each frame having a shape which is substantially the same as the shape of said like-sized peripheries; each barrier configured to allow flow of water while hindering flow of particulates; wherein the barriers of a first set of said at least two sets of panels have water flow and particulate hindering properties which are different from the water flow and particulate hindering properties of the barriers of a second set of said at least two sets of panels; and, (c) selecting only one of said panel sets and affixing only the panels of the selected one set to the sidewalls of the chamber, so said like-sized openings are covered by the barriers of the selected set of panels.

2. In the method of fabricating a leaching chamber for receiving and dispersing water when buried in soil, wherein the chamber is made of injection molded plastic, has a top, a length, an arch shape cross section, an interior for receiving water, an exterior, opposing side base flanges, and two opposing corrugated sidewalls comprised of alternating peak corrugations and valley corrugations, each sidewall running upwardly and inwardly toward the top of the chamber from one of said opposing side base flanges, wherein each opposing sidewall has a plurality of openings spaced apart along said chamber length; the improvement which comprises:

molding each corrugated sidewall with at least one opening in each peak corrugation of a plurality of said peak corrugations, wherein each at least one opening has a periphery;

separately forming a plurality of plastic barriers, wherein each barrier is shaped to substantially fit one said at least one opening and is comprised of geotextile sheet, each geotextile sheet having the property of enabling flow of water while hindering flow of particulates; and, affixing each of said plastic barriers directly only to a portion of the sidewall of the chamber which is in proximity of the periphery of a respective opening, so each barrier runs only across the respective opening to thereby hinder the movement of particulates therethrough during use of the chamber, while allowing flow of water therethrough.

3. The method of claim 2 wherein each barrier of said separately formed plurality of barriers comprises a frame to which the barrier is affixed.

4. A plastic leaching chamber made of molded plastic, for receiving and dispersing water when buried in soil during use; the chamber having an arch shape cross section, an interior, an exterior, a top, a bottom, a length having an associated lengthwise axis, a width, opposing side base flanges, and two opposing sidewalls, each sidewall rising from one of said opposing side base flanges and running upwardly and inwardly toward said top of the chamber, each sidewall characterized by alternating peak corrugations and valley corrugations running transverse to the length of the chamber; wherein each peak corrugation of each sidewall has at least one opening for passage of water, wherein each at least one opening has a periphery; the chamber comprising a plurality of geotextile sheets, each geotextile sheet shaped to substantially fit one said at least one opening and affixed directly to one of the chamber sidewalls at the periphery of a respective opening, to thereby enable outflow of water from the interior of the chamber to the exterior of the chamber while hindering inflow of particulate solids during use of the chamber.

5. The chamber of claim 4 wherein each geotextile sheet is directly affixed to one of the chamber sidewalls by means of adhesive or welding.

6. The chamber of claim 4 further comprising one or more struts integral with one of the sidewalls and running within each said at least one opening.

7. The chamber of claim 6 wherein each geotextile sheet is further affixed to said one or more struts.

8. A plastic leaching chamber made of molded plastic, for receiving and dispersing water when buried in soil during use; the chamber having an arch shape cross section, an interior, an exterior, a top, a bottom, a length having an associated lengthwise axis, a width, opposing side base flanges, and two opposing sidewalls, each sidewall rising from one of said opposing side base flanges and running upwardly and inwardly toward said top of the chamber, each sidewall characterized by alternating peak corrugations and valley corrugations running transverse to the length of the chamber; wherein each peak corrugation of each sidewall has at least one opening, for passage of water, each at least one opening having a periphery; wherein each sidewall comprises one or more lands running around the periphery of each said at least one opening; the chamber further comprising a plurality of geotextile sheets, each geotextile sheet affixed to one of the chamber sidewalls periphery of a respective opening at the location of said one or more lands; and wherein each sheet is shaped to substantially fit and cover the at least one opening, to the periphery of which the sheet is affixed; to thereby provide a barrier which enables outflow of water through the at least one opening from the interior of the chamber to the exterior of the chamber while hindering inflow of particulate solids during use of the chamber.

9. A chamber made of molded plastic, for receiving and dispersing water when buried in soil during use, the chamber having an arch shape cross section, an interior, an exterior, a top, a bottom, a length having an associated lengthwise axis, a width, opposing side base flanges, and two opposing corrugated sidewalls, each sidewall rising from one of said opposing side base flanges and running upwardly and inwardly toward said top of the chamber, wherein the sidewalls are characterized by alternating peak corrugations and valley corrugations running transverse to the length of the chamber;

wherein each opposing sidewall comprises a plurality of first portions and a plurality of second portions, each first portion having at least one opening for passage of water and each second portion having no openings for passage of water; the first portions and second portions spaced apart along the length of the chamber;

the chamber further comprising a plurality of separately formed barriers, each barrier comprising a sheet of geotextile having a construction which enables flow of water while hindering flow of particulate solids, each barrier shaped to substantially fit an at least one opening and affixed by means of adhesive or welding to one of the sidewalls of the chamber around the periphery of a respective opening which the barrier fits, to thereby cover said at least one opening.

10. The chamber of claim 9 wherein each barrier further comprises a frame.

11. The chamber of claim 10 wherein each barrier further comprises louvers within the frame.

* * * * *